US006516852B1

(12) United States Patent
Sandor

(10) Patent No.: US 6,516,852 B1
(45) Date of Patent: Feb. 11, 2003

(54) COMPACT DISC LABELING APPARATUS AND METHOD

(75) Inventor: Joseph Sandor, Corona Del Mar, CA (US)

(73) Assignee: Codax Technologies, Inc., Costa Mesa, CA (US)

( * ) Notice: Subject to any disclaimer, the term of this patent is extended or adjusted under 35 U.S.C. 154(b) by 0 days.

(21) Appl. No.: 09/573,397

(22) Filed: May 18, 2000

(51) Int. Cl.[7] ..... B65C 1/02

(52) U.S. Cl. ..... 156/391; 156/60; 156/556; 156/580; 206/307; 206/308.1

(58) Field of Search ..... 156/391, 556, 156/580, 60; 206/307, 308.1; D6/632, 634; D3/201, 206

(56) References Cited

U.S. PATENT DOCUMENTS 5,402,882 A * 4/1995 Bandy et al. ..... 206/310
5,715,934 A * 2/1998 Tobol et al. ..... 206/232
6,302,176 B1 * 10/2001 Chen ..... 156/391
6,363,987 B1 * 4/2002 Koch ..... 156/391

FOREIGN PATENT DOCUMENTS

DE 297 01 108 U1 * 3/1997
DE 29721676 U1 * 2/1998 ..... B65C/1/02
DE 29817456 U1 * 12/1998 ..... B65C/1/02
EP 0 855 713 A1 * 1/1998

OTHER PUBLICATIONS

Translation of European Patent No. 0 855 713–A1.*
Translation of German Patent No. 297 01 108–U1.*

* cited by examiner

*Primary Examiner*—Richard Crispino
*Assistant Examiner*—Sue A. Purvis
(74) *Attorney, Agent, or Firm*—Edgar W. Averill, Jr.

(57) ABSTRACT

A label applying apparatus and method for concentrically applying annular labels (having adhesive on one side) to compact discs. The apparatus has a similar size and shape as that of a conventional jewel case and has first and second platforms capable of hinging relative to each other between open and closed positions. When in the open position, a compact disc may be mounted on the first platform, and an annular label delicately retained on the second platform with the adhesive side up. Preferably, the annular label is retained on the second platform by means of several centrally located fingers which contact an inner circumference edge of the annular label. When the first and second platforms are hinged to the closed position, the annular label and the compact disc are concentrically aligned and joined together in a bonding relationship.

14 Claims, 7 Drawing Sheets

COMPACT DISC LABELING APPARATUS AND METHOD

BACKGROUND OF THE INVENTION

The field of the invention pertains to labeling devices. The invention relates more particularly to an apparatus and method for labeling optical storage discs, i.e. compact discs, with adhesive labels, wherein the dimensions and size of the apparatus are similar to a conventional jewel case used to package and store such compact discs.

Optical storage discs, more commonly known as compact discs ("CD"s), are used for computer, audio, video, and other applications involving electro-optically recorded and retrievable digital information. In particular, writeable compact discs, such as CD-R and CD-RW, have grown in popularity and usage by enabling users to record their own digitized music, video, data, and other information. With this increased use has grown a need to label these discs once they have been produced and recorded with content. This is because writeable compact discs have no apparent visual method for uniquely identifying a compact disc or determining its contents. While one method of compact disc labeling utilizes a silk-screening or similar printing process to imprint a graphic image or other pre-printed material on the top surface of a disc, this method is typically employed by large-scale manufacturers and would be too impractical for individuals desiring single or small run labeling applications.

Another known method employs annular self-adhesive labels having a gummed adhesive on one side and a non-adhesive markable surface on the other. The difficulty presented by adhesive labels is in accurately centering them on the compact discs. Proper centering is essential for achieving a high-speed, steady-state spin, which is necessary to ensure proper reading and transfer of the digital information stored thereon. Moreover, unbalanced spinning of the compact disc can cause damage to the motor of the compact disc player device. To this end, various types of devices have been developed in an effort to properly center adhesive labels when fixedly applying them to the non-reading side of compact discs.

In particular, many prior art labeling devices feature a vertically operating piston-type configuration wherein a piston/plunger operates to combine an annular label and a compact disc together along a central axis of motion. A representative example of such an arrangement is shown in U.S. Pat. No. 5,951,819, which discloses a label applying apparatus having a base which supports a label, and a plunger which supports a compact disc. The plunger is positioned within a center opening of the base and internally supported by a biasing spring against the base. In use, the plunger is telescopically compressed and urged into the center opening of the base against the action of the spring to join the label with the compact disc.

Perhaps the greatest problem with these types of adhesive labeling devices exemplified by the '819 patent is the amount of space required to store such devices. In particular, the relatively large footprint and bulk of these prior art devices may pose a burden on users when attempting to conveniently and inconspicuously store the device away when not in use. The typical piston-type configuration requires and effectively occupies a cylindrical-shaped volume, which often cannot be stored in an easily accessible location near where compact discs are stored, e.g. a compact disc rack. Because such adhesive labeling devices are typically for home and personal use by individual users, and not for industrial or manufacturing applications, it would be advantageous to provide a compact labeling device with a small footprint and capable of being kept together with other compact discs for easy access.

Furthermore, because the size and number of moving components of these prior art labeling devices are relatively large in relation to the compact discs themselves, manufacture and assembly of such prior art labeling devices may come at a high cost. Thus, it can be further appreciated that a smaller, more compact device having a minimal number of moving parts would give such compact labeling devices greater consumer appeal to a larger number of users wishing to label their own compact discs.

BRIEF SUMMARY OF THE INVENTION

It is therefore an object of the present invention to provide a simple and efficient optical disc labeling apparatus capable of concentrically adhering an annular label to a compact disc.

It is a further object of the present invention to provide an optical disc labeling apparatus which operates to apply an annular label to a compact disc by hinging a compact disc support surface and a label support surface relative to each other.

It is a still further object of the present invention to provide an optical disc labeling apparatus having a similar size, shape, and configuration as a conventional compact disc jewel case whereby convenient and space-efficient storage of the apparatus can be realized.

It is a still further object of the present invention to provide a cost-effective optical disc labeling apparatus having a minimal number of components and capable of being mass-produced by conventional manufacturing methods.

The present invention is for an apparatus for concentrically applying an annular label having an adhesive side to a compact disc. The apparatus generally comprises a first platform which has a compact disc support surface and means for mounting said compact disc thereon, and a second platform which has a label support surface and means for temporarily retaining the annular label thereon. The second platform is hingedly connected to the first platform at a pivot end thereof for hinging between an open position and a closed position. In the open position, the compact disc is mounted on the compact disc support surface and the annular label is temporarily retained on the label support surface with the adhesive side up. And in the closed position, the compact disc and the annular label are concentrically aligned and adhered together in a bonding relationship, whereby the annular label is concentrically transferred to the compact disc when hinged to the closed position.

DETAILED DESCRIPTION OF THE PREFERRED EMBODIMENTS

Figure 1:
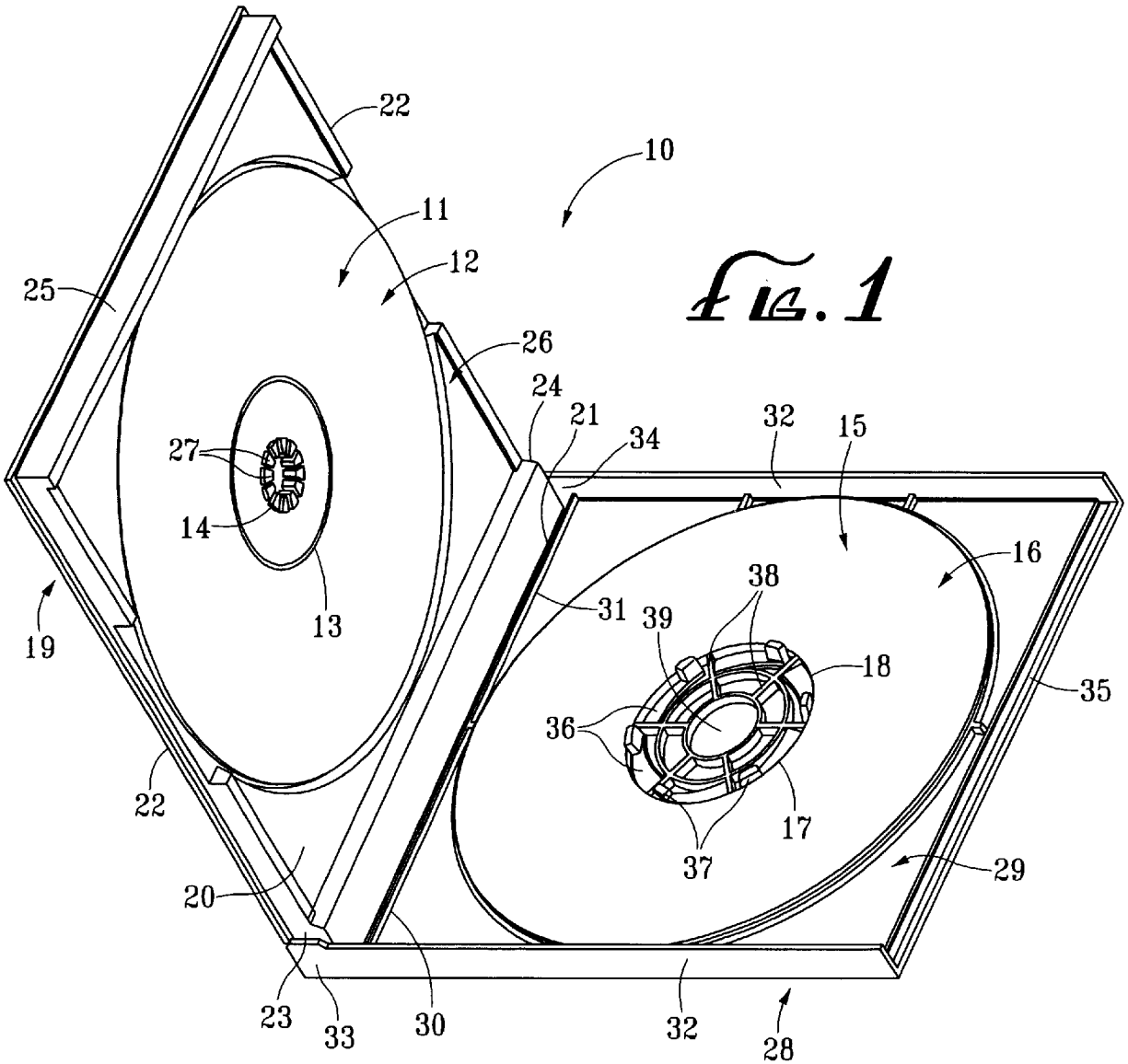
FIG. 1 is a perspective view of the compact disc labeling apparatus in the open position, with a compact disc and annular label mounted thereon.
Figure 2:
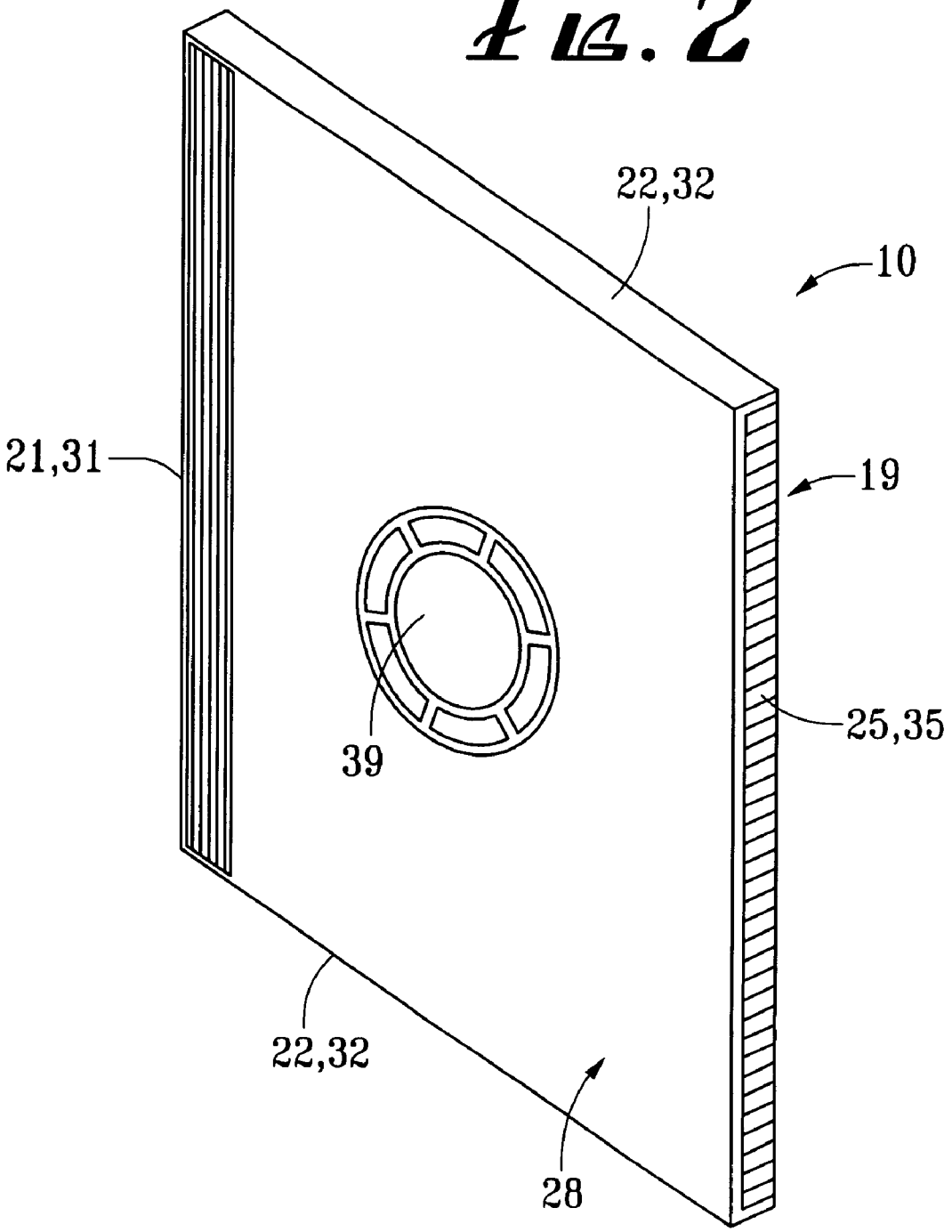
FIG. 2 is a perspective view of the compact disc labeling apparatus in the closed position illustrating the compact and slim configuration of the compact disc labeling apparatus.

Referring now to the drawings, FIGS. 1–6 show various views of the compact disc labeling apparatus, generally indicated at reference character 10, for applying a self-adhesive annular label 15 to a compact disc 11. The apparatus 10 has two basic component parts, a first or base platform, generally indicated at reference character 19, and a second or cover platform, generally indicated at reference character 28, which are hinged together to move between an open position (FIGS. 1, 3–6) and a closed position (FIG. 2). The apparatus 10 has similar dimensions, size, and shape as that of conventional "jewel cases" which are commonly used to package and store compact discs. It is appreciated, therefore, that the labeling apparatus 10 has a slim and compact configuration and design which completely and efficiently encloses a compact disc 11 when hinged to the closed position (see FIG. 2). It is notable that conventional jewel cases usually include planar, generally square-shaped base and cover portions which are hinged along a pivot edge in order to allow access to the interior of the case. The base portion of such cases is usually provided with a disc holder having a plurality of centrally located, radially inwardly extending elements which grasp the center opening of the compact disc. And the cover portion of the case usually includes slider tabs which extend inwardly from the side edges to hold printed literature slidably positioned thereon.

It is further notable that the compact disc 11 is made from a plastic material in a manner known in the relevant art, and has a top surface 12 containing a metallic coating, and an opposing bottom surface (not shown) embedded with digitized data. The bottom surface is transparent to permit a laser to encode data thereon, as well as retrievably "read" data therefrom. Furthermore, the compact disc 11 has a centrally located hole 14 utilized for mounting and spin-operation of the compact disc 11. The area immediately surrounding central hole 14 up to a circular edge 13 is a transparent material not for storing data, and can therefore be contacted and handled without the possibility of damaging or losing data. In contrast, the region of the compact disc 11 extending from the circular edge 13 up to the outer edge of the compact disc 11 operates to store data thereon and is considered the readable area.

Figure 5:
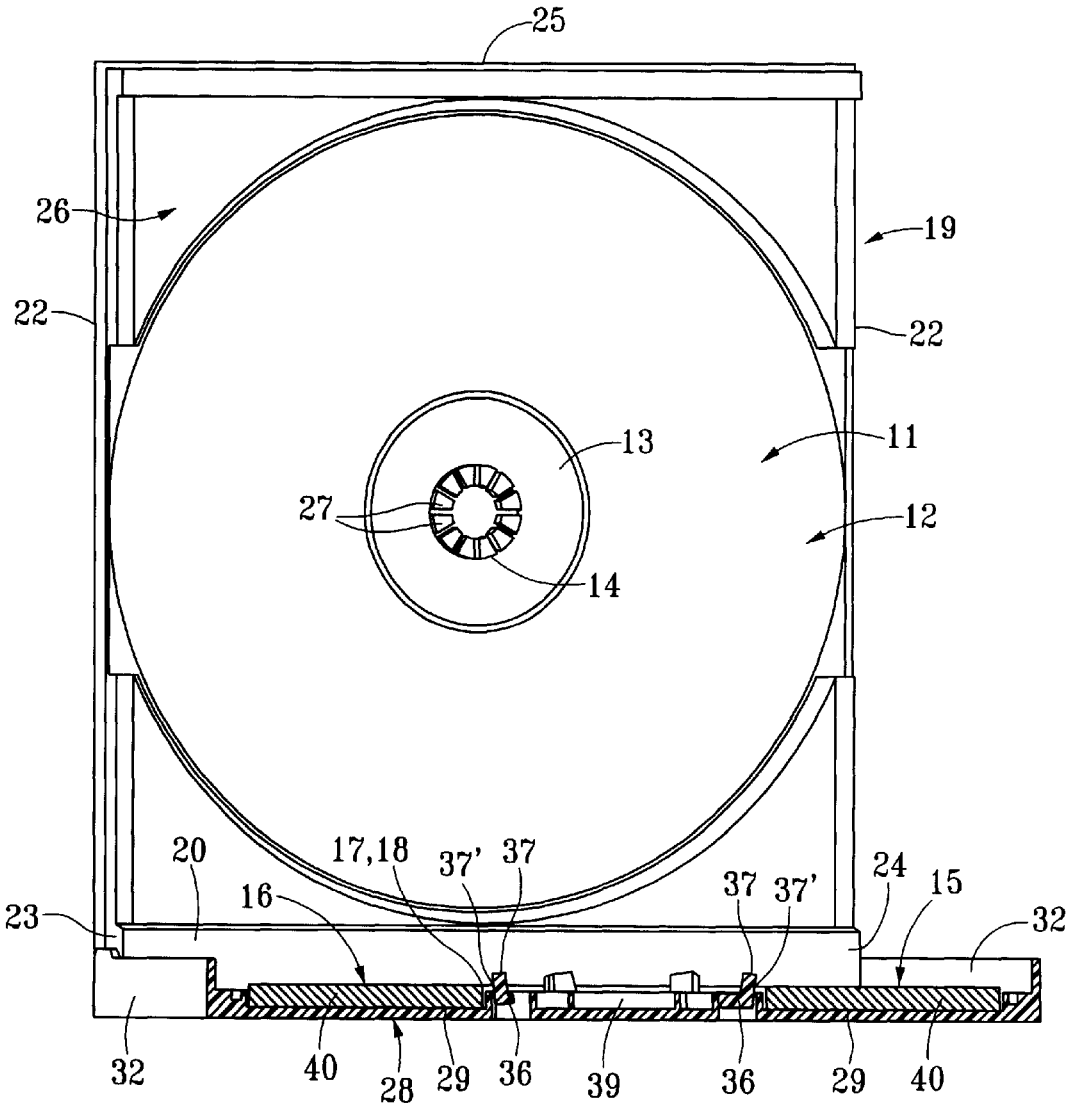
FIG. 5 is a partly cross-sectional front view of the compact disc labeling apparatus taken along the line 5—5 of FIG. 3.
Figures 6, 7:
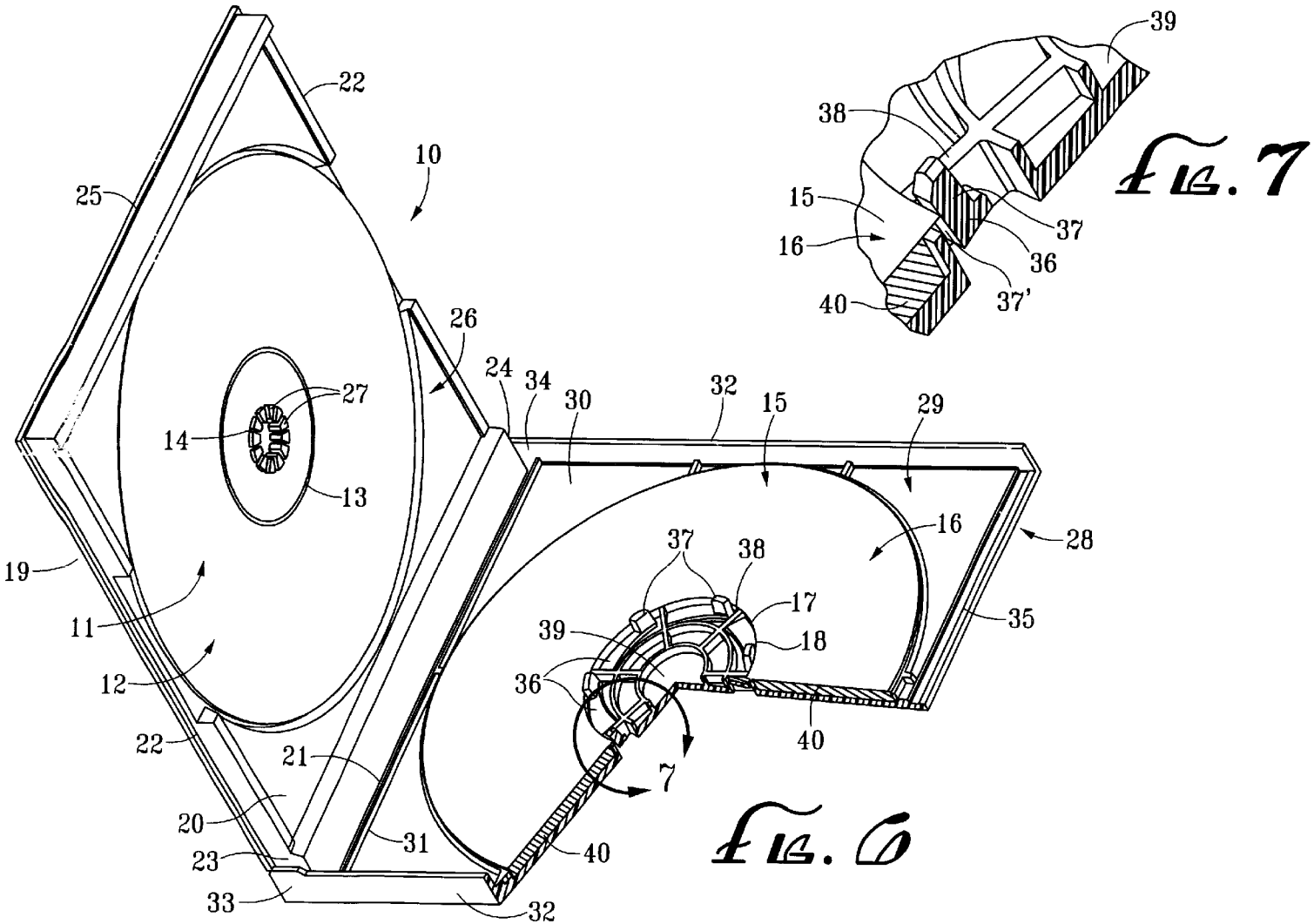
FIG. 6 is a perspective view of the compact disc labeling apparatus similar to FIG. 1 with the second platform partly cut out to show a radial cross section of the second platform and annular label.
FIG. 7 is an enlarged view of the radial cross-section of the second platform and annular label taken along the circle 7 of FIG. 6.
Figure 10:
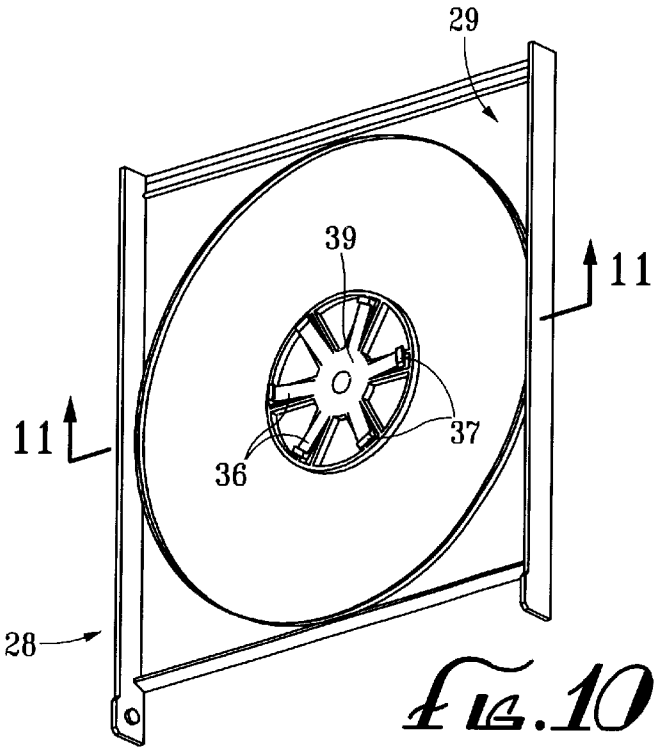
FIG. 10 is a perspective view of the second platform of the compact disc labeling apparatus embodying a third preferred embodiment of the means for temporarily retaining the annular label.
Figure 11:
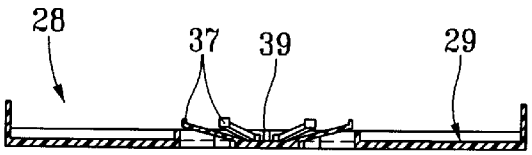
FIG. 11 is a cross-sectional view of the second platform of the compact disc labeling apparatus taken along the line 11—11 of FIG. 10.

As can be best seen in FIGS. 1, 5, and 6, the first platform 19 has a generally planar configuration similar to the configuration of a base portion of a jewel case. The first platform 19 comprises a compact disc support surface 26 which extends to and is bounded by four edges: a first outer edge 25, two opposing side edges 22, and a first pivot edge 21 at a first pivot end 20. The compact disc 11 may be mounted on the compact disc support surface 26 with the top surface 12 facing up, i.e. facing away from the securing surface. More particularly, the compact disc 11 is positioned in a recessed portion of the compact disc support surface 26 which is contoured to seat the compact disc 11 therein. In any case, the compact disc 11 is mounted by means for mounting a compact disc which is preferably a disc holder of the type commonly used in jewel cases, as discussed above, having centrally located, radially inwardly extending elements 27. These extending elements 27 partially and snugly extend through and grasp the centrally located hole 14 of the compact disc 11 to effectively mount the compact disc 11 on the compact disc support surface 26.

Figure 3:
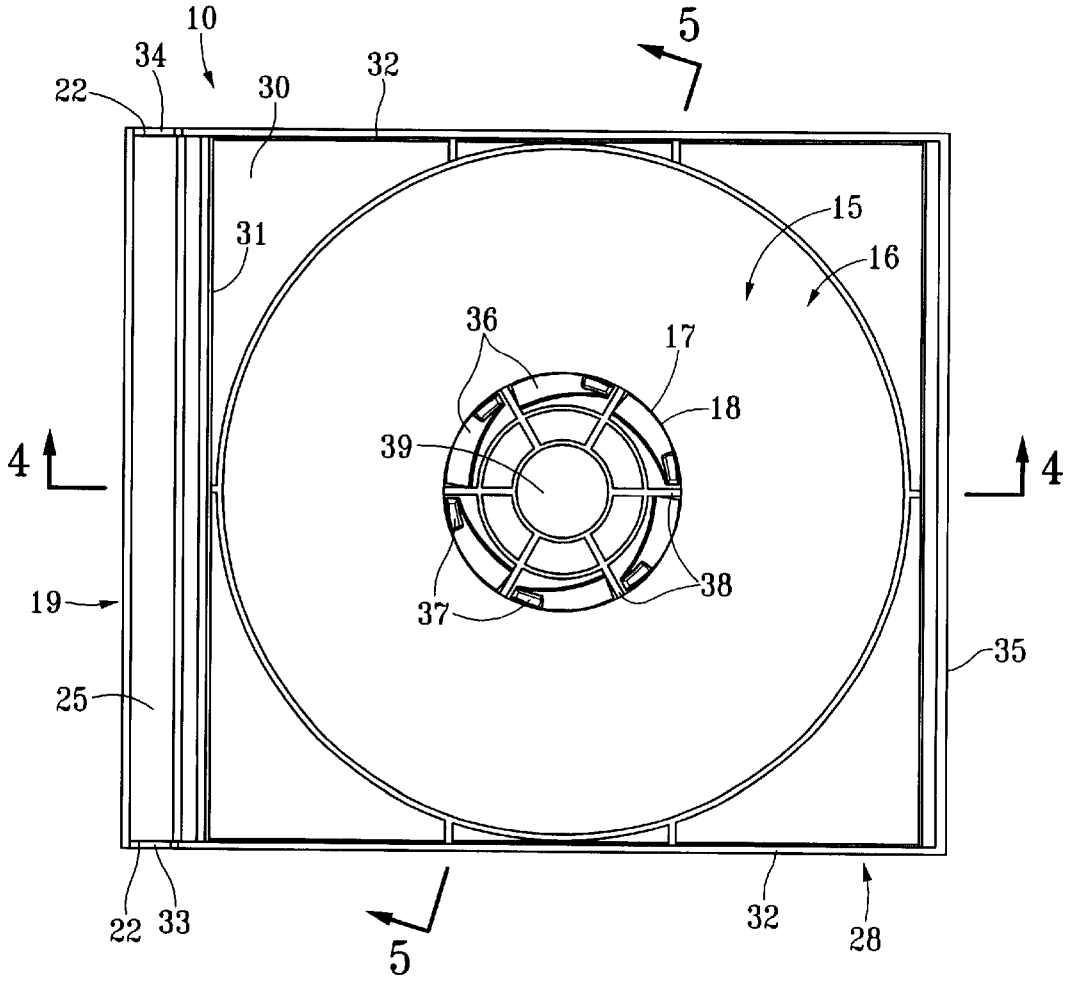
FIG. 3 is a top view of the compact disc labeling apparatus shown in FIG. 1 in the open position.

As can be best seen in FIGS. 1, 3, and 6, the second platform 28 also has a generally planar configuration similar to the configuration of a cover portion of a jewel case. The second platform 28 comprises a label support surface 29 which extends to and is bounded by four edges: a second outer edge 35, two opposing side edges 32, and a second pivot edge 31 at a second pivot end 30. The label support surface 29 functions to seatably support the self-adhesive annular label 15, which has a gummed adhesive side 16 and an opposing, non-adhesive markable side (not shown). Additionally, the self-adhesive annular label 15 has a central hole 17 defined by an inner circumference edge 18 typically having a diameter no less than the circular edge 13 of the compact disc. Preferably, a resiliently biasing element 40 is detachably or fixedly positioned on the label support surface 29 which functions to keep the self-adhesive annular label 15 horizontally oriented. And preferably still, the resiliently biasing element is a foam material 40 which is cut to form fit a recessed portion of the label support surface 29, similar to the recessed portion of the first platform 19.

Figure 8:
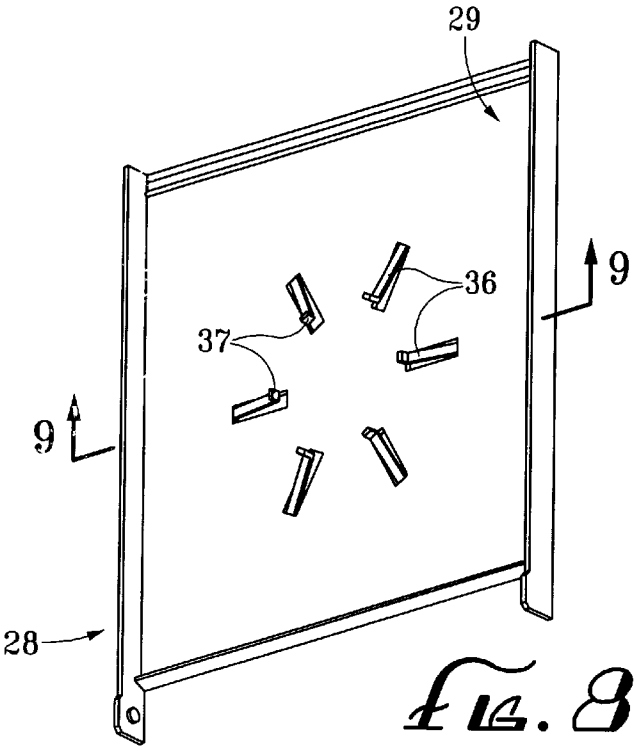
FIG. 8 is a perspective view of the second platform of the compact disc labeling apparatus embodying a second preferred embodiment of the means for temporarily retaining the annular label.
Figure 9:
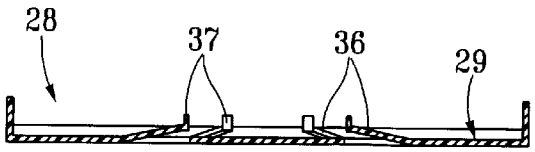
FIG. 9 is a cross-sectional view of the second platform of the compact disc labeling apparatus taken along the line 9—9 of FIG. 8.

The annular label 14 may be temporarily retained on the label support surface 29, with the adhesive side 16 up and facing away from the label support surface 29, by means for temporarily retaining the annular label 15 on the label support surface 29. Generally, as shown in the figures, the means for temporarily retaining the annular label 15 preferably utilizes at least two fingers 36, located at the center of the label support surface 29. The fingers 36 preferably extend from a fixed end to a suspended end which is adapted to lightly contact the inner circumference edge 18 of the annular label 15 in a resiliently biasing manner. A first preferred embodiment of the means for temporarily retaining can be best seen in FIGS. 1, 3, 6, and 7 having a hub 39 and spoke 38 configuration, with each of the fixed ends of the fingers 36 being transversely secured to a corresponding spoke 38. Alternatively, second and third preferred embodiments of the means for temporarily retaining are shown in FIGS. 8, 9 and 10, 11, respectively. In particular, the fingers 36 of the second preferred embodiment of the means for temporarily retaining are shown in FIGS. 8 and 9 radially inwardly extending in a converging manner with the fixed ends positioned outside the suspended ends. And in FIGS. 10 and 11, the third preferred embodiment of the means for temporarily retaining is shown also having a hub 39 and spoke 38 configuration, with the fingers 36 radially extending outward from the hub 39 in a diverging manner. It is notable that while the third configuration may produce some nicks along the inner circumference edge 18 of the annular label 15 due to the particular movement of its resiliently biasing fingers 36, it would not substantially interfere with the retaining function provided by the fingers 36.

In any case, the fingers 36 shown in the three preferred embodiments preferably also have tabs 37 at its suspended ends which actually effect contact with the inner circumference edge 18 of the annular label 15 along a contact surface 37' (FIGS. 5 and 7). Preferably, as can be best seen in FIGS. 5 and 7, the top end of the contact surface 37' of each tab 37 is outwardly angled, such that the inner circumference edge 18 of the annular label 15 is prevented from slipping past the tabs 37. It is notable that the angle of the tabs 37 need only be very slight to sufficiently temporarily retain the annular label 15 thereagainst. Furthermore, it is notable that while the compact disc 11 is considered to be "mounted" on the compact disc support surface 26, the annular label 15 is "temporarily retained" on the label support surface 29, indicating a transitional presence thereon. More particularly, the annular label 15 remains on the label support surface 29 only when in the open position, and is easily disengaged, separated and transferred to the compact disc 11 when in the closed position (see discussion below). In this regard, "temporarily retaining" indicates holding the annular label 15 in a manner which is minimally sufficient to keep it against the label support surface 29, and which easily and simply releases the annular label 15 with little or no effort.

Figure 4:
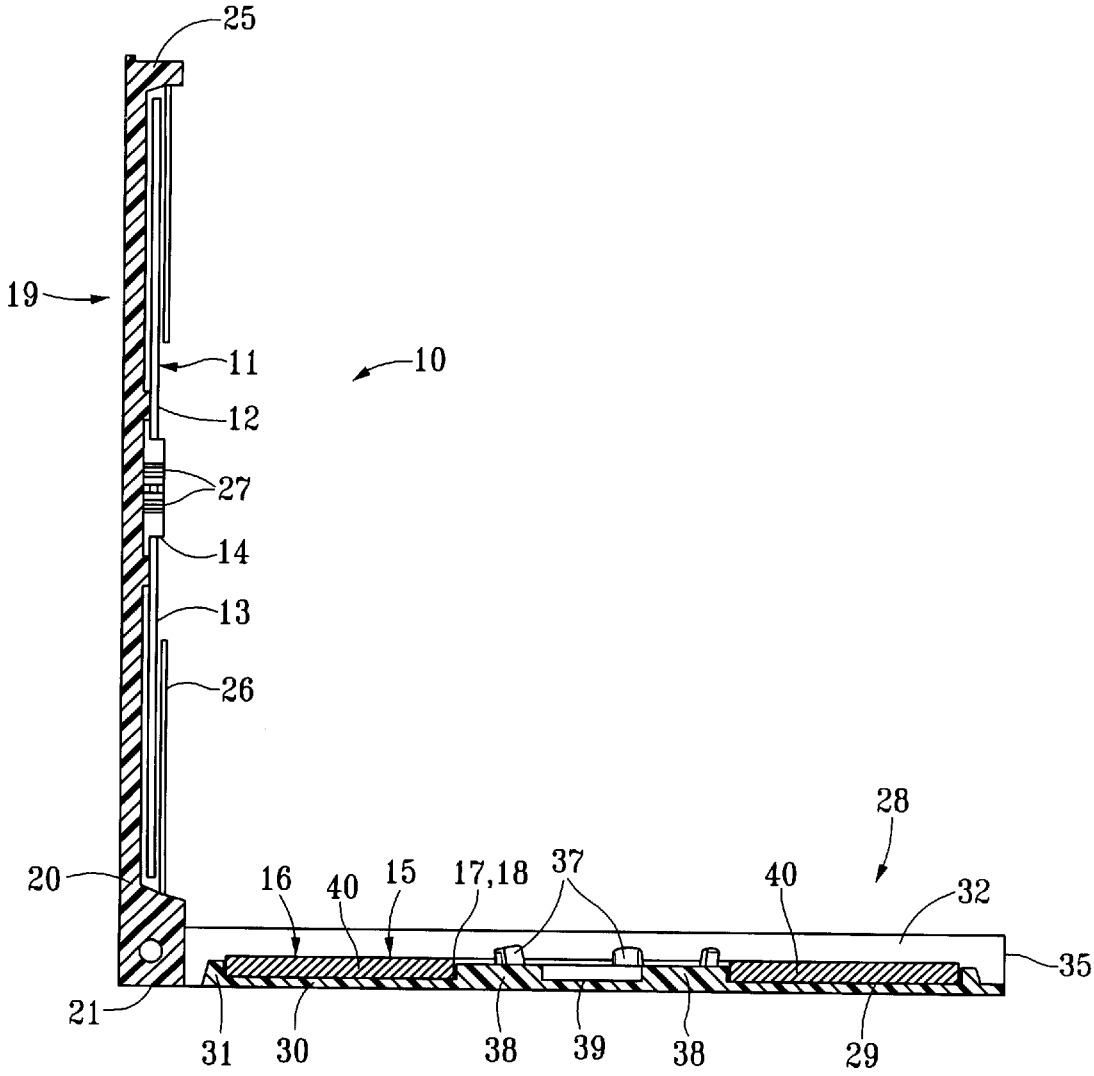
FIG. 4 is a cross-sectional side view of the compact disc labeling apparatus taken along the line 4—4 of FIG. 3.

As best shown in FIGS. 1, 4, and 6, the first pivot end 20 of the first platform 19 is hinged to the second pivot end 30 of the second platform 28 along the corresponding pivot edges 21, 31. The pair of side edges 22 of the first platform 19 terminate near the first pivot end 20 at hinge corners 23, 24, and the pair of side edges 32 of the second platform 28 terminate near the second pivot end 30 at hinge plates 33, 34. The hinge plates 33, 34 are pivotally secured to the corresponding hinge corners 23, 24 at pivot joints, which are preferably comprised of pivot pin and hole combinations (not shown).

In this manner, the first and second platforms 19, 29 may hinge relative to each other about their respective pivot ends 20, 30, between an open position and a closed position. Initially, the open position may be obtained by pulling apart the two platforms at the first and second outer edges, 25 and 35, respectively. In the open position, the compact disc 11 may be mounted on the first platform 19 with the top side 12 up, and the annular self-adhesive label 15 may be temporarily retained on the label support surface 29 with the adhesive side 16 up. The two platforms are subsequently hinged together to the closed position (FIG. 2) such that the respective outer edges 25, 26 and side edges 22, 32 of the first and second platforms 19, 28 are again in contact. Preferably, the step of hinging the two platforms 19, 28 together to the closed position entails keeping the second platform 29 steady at a horizontal reference position while hingeably transitioning the first platform 19 alone. This has the advantage of utilizing gravity to help prevent the annular label 15 from curling or otherwise repositioning itself during the transitional hinging step from the open and closed positions. In any case, the means for mounting the compact disc 11 and the means for temporarily retaining the annular label 15 are adapted and indexed in a manner to concentrically align the compact disc 11 and the annular label 15 when in the closed position. Thus, in the closed position, the top side 12 of the compact disc 11 is brought in contact with the adhesive side 16 of the annular label 15 to establish a bonding relationship by virtue of the gummed adhesive. The foam 40 has sufficient thickness so that it is compressed when the first platform 19 is closed against the second platform 28, thereby pressing the adhesive side 16 of the label 15 against the compact disc 11. A preferred foam thickness (uncompressed) is about one-eighth inch, which is preferably compressed about twenty-five percent when the chassis is closed. Once bonded, the two platforms 19, 28 may once again be pulled apart along the first and second outer edges 25, 35, to allow access to the newly labeled compact disc. The difference between the means for mounting the compact disc 11 and the means for temporarily retaining the annular label 15 is apparent in the post-adhesion, reopening process, wherein the stronger grasp of the extending elements 27 of the means for mounting is more than sufficient to overcome the resiliently biasing and retaining contact of the tabs 37 and fingers 36 of the means for temporarily retaining. Thus the now bonded label may easily separate from the label support surface 29 without damaging the inner circumference edge 18 of the annular label 15.

In a second embodiment of the compact disc labeling apparatus 10, the second platform 28, as discussed above, may operate as an independent attachment for use with an existing base portion of a conventional jewel case. Furthermore, it is notable that while the label support surface 29 is preferably integrally formed into the second platform 28, it can alternatively be produced as an independent component which is fixedly insertable to an existing cover portion of a conventional jewel case, preferably by utilizing the slider tabs (not shown) of the conventional jewel case.

Construction of the compact disc labeling apparatus 10 is preferably made of a durable material, such as impact polystyrene, which would provide greater strength and flexibility than the crystal polystyrene commonly used for conventional jewel cases. The greater durability of impact polystyrene would enable greater number of cycles of repeated use without failure.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An apparatus for concentrically applying an annular label having an adhesive side to a compact disc, said apparatus comprising:

a first platform having a compact disc support surface and means for mounting said compact disc thereon; and a second platform having a label support surface and means for temporarily retaining said annular label thereon, and wherein said means for temporarily retaining has at least two fingers adapted to retainably contact an inner circumference edge of said annular label and wherein each of said at least two fingers has resiliently biasing means, said second platform hingedly connected to said first platform at a pivot end thereof for hinging between an open position wherein said compact disc is mounted on said compact disc support surface and said annular label is temporarily retained on said label support surface with the adhesive side up, and a closed position wherein said compact disc and said annular label are concentrically aligned and adhered together in a bonding relationship, whereby said annular label is concentrically transferred to said compact disc when hinged from said open position to said closed position.

2. The apparatus as in claim 1, further comprising a resiliently biasing element positioned on said label support surface.

3. The apparatus as in claim 2, wherein said resiliently biasing element is a foam material.

4. The apparatus as in claim 1, wherein said means for temporarily retaining is positioned at the center of said label support surface.

5. The apparatus as in claim 4, wherein each of said at least two fingers has a tab at a suspended end thereof for retainably contacting said inner circumference edge of said annular label.

6. A labeling system for concentrically applying annular labels to compact discs, said labeling system comprising:

a compact disc;

an annular label having an adhesive side;

a first platform having a compact disc support surface and means for mounting said compact disc thereon; and a second platform having a label support surface and means for temporarily retaining said annular label thereon comprising at least two fingers positioned about the center of said label support surface and said at least two fingers adapted to attachably contact an inner circumference edge of said annular label, said second platform hingedly connected to said first platform at a pivot end thereof for hinging between an open position wherein said compact disc is mounted on said compact disc support surface and said annular label is temporarily retained on said label support surface with the adhesive side up, and a closed position wherein said compact disc and said annular label are concentrically aligned and adhered together in a bonding relationship and wherein said label support surface includes a resiliently biasing element positioned on said label support surface comprising a foam material, whereby said annular label is concentrically transferred to said compact disc when hinged from said open position to said closed position.

7. The apparatus as in claim 6, wherein each of said at least two fingers has resiliently biasing means.

8. The apparatus as in claim 6, wherein each of said at least two fingers has a tab at a suspended end thereof for retainably contacting said inner circumference edge of said annular label.

9. A label applicator attachment for use with a base platform of a conventional jewel case for concentrically applying an annular label having an adhesive side to a compact disc, said base platform having a compact disc support surface and means for mounting said compact disc thereon, said label applicator attachment comprising:

a cover platform having a label support surface and means for temporarily retaining said annular label thereon, said cover platform hingedly connected to said base platform at a pivot end thereof for hinging between an open position wherein said compact disc is mounted to said compact disc support surface and said annular label is temporarily retained on said label support surface with the adhesive side up, and a closed position wherein said compact disc and said annular label are concentrically aligned and adhered together in a bonding relationship and wherein said annular label is temporarily retained on said label support surface by at least two fingers located at a center of the label support surface and said fingers extend from a fixed end to a suspended end and which is adapted to lightly contact an inner circumferential edge of said annular label, whereby said annular label is concentrically transferred to said compact disc when hinged from said open position to said closed position.

10. The apparatus as in claim 9, further comprising a resiliently biasing foam element positioned on said label support surface.

11. The apparatus as in claim 10, wherein each of said at least two fingers has resiliently biasing means.

12. The apparatus as in claim 10, wherein each of said at least two fingers has a tab at a suspended end thereof for retainably contacting said inner circumference edge of said annular label.

13. A method for concentrically applying an annular label having a central opening having an inner circumferential edge having an adhesive side to a compact disc, said method comprising the steps of:

providing a label applicator comprising a first platform having a compact disc support surface and means for mounting said compact disc thereon, and a second platform having a label support surface and means for temporarily retaining said annular label thereon, said second platform hingedly connected to said first platform at a pivot end thereof for hinging between an open position and a closed position, in said open position, mounting said compact disc on said compact disc supporting surface of said first platform;

in said open position, temporarily retaining said annular label on said label supporting surface of said second platform with the adhesive side up by pressing the central opening over a plurality of fingers held by said label supporting surface; and hinging said first and second platforms relative to each other to said closed position wherein said compact disc and said annular label are concentrically aligned and adhered together in a bonding relationship.

14. The method as in claim 13, where in said step of hinging said first and second platforms relative to each other to said closed position comprises pivotally transitioning said first platform while maintaining said second platform at a reference position.

* * * * *